US008638035B2

(12) United States Patent
Baik et al.

(10) Patent No.: US 8,638,035 B2
(45) Date of Patent: Jan. 28, 2014

(54) TERAHERTZ RADIATION SOURCES AND METHODS OF MANUFACTURING THE SAME

(75) Inventors: Chan-wook Baik, Yongin-si (KR); Joo-ho Lee, Hwaseong-si (KR); Hyung-bin Son, Seoul (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 674 days.

(21) Appl. No.: 12/805,002

(22) Filed: Jul. 7, 2010

(65) Prior Publication Data

US 2011/0169405 A1 Jul. 14, 2011

(30) Foreign Application Priority Data

Jan. 11, 2010 (KR) ..... 10-2010-0002382

(51) Int. Cl.
*H01J 7/24* (2006.01)

(52) U.S. Cl.
USPC ..... 315/111.81

(58) Field of Classification Search
USPC ..... 315/111.81
See application file for complete search history.

(56) References Cited

U.S. PATENT DOCUMENTS

| | | | | |
|---|---|---|---|---|
| 4,315,194 | A * | 2/1982 | Connolly | 315/3.6 |
| 4,888,776 | A * | 12/1989 | Dolezal et al. | 372/2 |
| 6,909,104 | B1 | 6/2005 | Koops et al. | |
| 6,987,360 | B1 | 1/2006 | Caplan et al. | |
| 7,259,510 | B1 | 8/2007 | Gammel et al. | |
| 7,282,776 | B2 | 10/2007 | Gorrell | |
| 7,361,916 | B2 | 4/2008 | Gorrell | |
| 2004/0108550 | A1 * | 6/2004 | Jin | 257/342 |
| 2004/0196541 | A1 | 10/2004 | Darling et al. | |
| 2005/0286602 | A1 | 12/2005 | Gunn et al. | |
| 2007/0257619 | A1 * | 11/2007 | Gorrell et al. | 315/5.39 |
| 2009/0096378 | A1 | 4/2009 | Barnett et al. | |
| 2009/0284126 | A1 * | 11/2009 | Protz et al. | 313/495 |

FOREIGN PATENT DOCUMENTS

| | | |
|---|---|---|
| JP | 02-056105 | 2/1990 |
| JP | 2005-123458 | 5/2005 |
| JP | 2006-162736 | 6/2006 |
| JP | 2006-227433 | 8/2008 |
| JP | 2009-043787 | 2/2009 |

OTHER PUBLICATIONS

European Search Report dated Jun. 16, 2011 for EP Application No. 10181822.7.

* cited by examiner

*Primary Examiner* — Douglas W Owens
*Assistant Examiner* — Jianzi Chen
(74) *Attorney, Agent, or Firm* — Harness, Dickey & Pierce, P.L.C.

(57) ABSTRACT

A terahertz radiation source includes: a cathode configured to emit an electron beam, an anode configured to focus the electron beam emitted from the cathode; a collector facing the cathode and configured to collect the emitted electron beam focused by the anode; an oscillating circuit positioned between the anode and the collector and configured to convert energy of a passing electron beam into electromagnetic wave energy; and an output unit connected to the oscillating circuit and configured to externally emit the electromagnetic wave energy.

21 Claims, 6 Drawing Sheets

TERAHERTZ RADIATION SOURCES AND METHODS OF MANUFACTURING THE SAME

CROSS-REFERENCE TO RELATED APPLICATION(S)

This application claims priority under 35 U.S.C. §119 to Korean Patent Application No. 10-2010-0002382, filed on Jan. 11, 2010, in the Korean Intellectual Property Office, the entire contents of which are incorporated herein by reference.

BACKGROUND

1. Field

One or more example embodiments relate to terahertz radiation sources and methods of manufacturing the same, for example, terahertz radiation sources implemented on a single substrate and methods of manufacturing the same.

2. Description of the Related Art

The terahertz ($10^{12}$ Hz) band is relatively important for applications in molecular optics, biological physics, medical science, spectroscopy, image processing, security areas, etc. Though the terahertz band ranges from the microwave band to the optical band, there are only a few radiation sources and amplifiers operating in the terahertz band due to various physical and engineering limitations. Recently, such terahertz band radiation sources and terahertz band amplifiers have been developed by using relatively new concepts and advanced micro processing technologies. A variety of approaches have been used in attempting to increase the frequency at which existing microwave band radiation sources operate or to lower the operating frequency to be within the terahertz band by using optical instruments such as a semiconductor or femtosecond laser. Recently, attempts to manufacture a terahertz band radiation source for generating terahertz electromagnetic waves using micro processing technology have been conducted.

SUMMARY

One or more example embodiments provide terahertz radiation sources implemented monolithically on a single chip and methods of manufacturing terahertz radiation sources.

Additional aspects will be set forth in part in the description which follows and, in part, will be apparent from the description, or may be learned by practice of the presented example embodiments.

At least one example embodiment provides a terahertz radiation source. According to at least this example embodiment, a cathode is configured to emit an electron beam, and an anode is configured focus the electron beam emitted from the cathode. A collector is arranged to face the cathode and configured to collect the emitted electron beam focused by the anode. An oscillating circuit is positioned between the anode and the collector, and configured to convert energy of a passing electron beam into electromagnetic wave energy. An output unit is connected to the oscillating circuit. The output unit is configured to externally emit the electromagnetic wave energy.

At least one other example embodiment provides a method of manufacturing a terahertz radiation source. According to at least this example embodiment, the method includes: etching a substrate layer formed on an insulating layer to form an oscillating element layer including a cathode region, an anode region, an oscillating circuit region, and a collector region; and forming an electron beam emitter source in the cathode region of the substrate layer.

At least one other example embodiment provides a terahertz radiation source including: an insulating layer and an oscillating element layer. The oscillating element layer is formed by etching a substrate layer provided on the insulating layer in a pattern. The oscillating element layer includes: a cathode configured to emit an electron beam; an anode configured to focus the electron beam emitted from the cathode; a collector facing the cathode and configured to collect the emitted electron beam focused by the anode; an oscillating circuit positioned between the anode and the collector and configured to convert energy of a passing electron beam into electromagnetic wave energy; and an output unit connected to the oscillating circuit and configured to externally emit the electromagnetic wave energy.

According to at least some example embodiments, an electron beam emitting surface of the cathode may be perpendicular to the substrate layer and/or may be concave with respect to an emission direction of an electron beam. The cathode may include a field emission type electron beam emitter source, a thermal electron emission type electron beam emitter source, a photo-excitation type electron beam emitter source, or the like.

The oscillating circuit may have a photonic crystal structure in which a plurality of vertically extending portions are arranged in a two-dimensional array. The vertically extending portions may be formed by etching the substrate layer. The output unit may include a slot formed adjacent to the anode in a region where the oscillating circuit is positioned. The slot may penetrate the insulating layer and the substrate layer. In this example, at least one of an arrangement and a shape of the vertically extending portions of the oscillating circuit positioned between the anode and the output unit may be different from one of the vertically extending portions of the oscillating circuit positioned between the output unit and the collector.

According to at least some example embodiments, the vertically extending portions of the oscillating circuit may be arranged to form a waveguide that is folded at least twice (e.g., when seen from the top). An end of the folded-waveguide may be open to the outside to form the output unit.

The oscillating circuit may have a folded waveguide resonance structure such that the oscillating circuit crosses a path of an electron beam a plurality of times. The oscillating circuit may be formed by etching the substrate layer in a relatively long groove shape folded at least twice. An end of the groove may be open to the outside to form the output unit.

The oscillating circuit may be formed by etching the substrate layer to have a coupled-cavity resonance structure including a plurality of cavities arranged at both sides of the oscillating circuit with a path between the cavities, and a plurality of connecting portions connecting the cavities. An electron beam may pass along the path, and an end of the cavities may be open to the outside.

The oscillating circuit may have at least one selected from the group including a photonic crystal structure, a nano resonance structure, a coupled-cavity resonance structure, a folded-waveguide resonance structure, a spiral oscillating structure, a groove structure, a forward wave structure, a surface plasmon exciting structure and a meta-material structure for oscillating terahertz electromagnetic wave.

The terahertz radiation source may further include a cover covering the oscillating circuit. The cover may include at least a second oscillating circuit having a structure symmetrical with regard to the oscillating circuit.

The terahertz radiation source may further include a cover for covering the cathode, the anode, the collector and the oscillating circuit.

The terahertz radiation source may further include a cover having a structure symmetrical with regard to the terahertz radiation source.

At least one of the cathode, the anode, the collector and the oscillating circuit may include a metal layer coated on the etched substrate layer.

The insulating layer and the substrate layer may be layers of a silicon on insulator (SOI) substrate.

At least one other example embodiment provides a method of manufacturing a terahertz radiation source. According to at least this example embodiment, a substrate including a substrate layer provided on an insulating layer is prepared. The substrate layer is etched to form an oscillating element layer including a cathode region, an anode region, an oscillating circuit region, and a collector region. An electron beam emitter source is formed in the cathode region of the substrate layer.

According to at least some example embodiments, the forming of the oscillating element layer includes: dividing and etching the substrate layer into the cathode region, the anode region, the oscillating circuit region and the collector region; coating a metal layer on a region including the cathode region and the anode region on the substrate layer; and etching a region of the substrate layer, except for the cathode region, the anode region, the oscillating circuit region and the collector region, until the insulating layer is exposed.

The electron beam emitting surface of the cathode region may be perpendicular or substantially perpendicular to the insulating layer and/or may be concave with respect to an emission direction of an electron beam.

The oscillating circuit region may be patterned to have at least one of a photonic crystal structure, a nano resonance structure, a coupled-cavity resonance structure, a folded-waveguide resonance structure, a spiral oscillating structure, a groove structure, a forward wave structure, a surface plasmon exciting structure and a meta-material structure for oscillating terahertz electromagnetic wave. The substrate may be a silicon on insulator (SOI) substrate.

BRIEF DESCRIPTION OF THE DRAWINGS

Example embodiments will become more apparent from the following description of the accompanying drawings in which.

DETAILED DESCRIPTION

Figure 1:
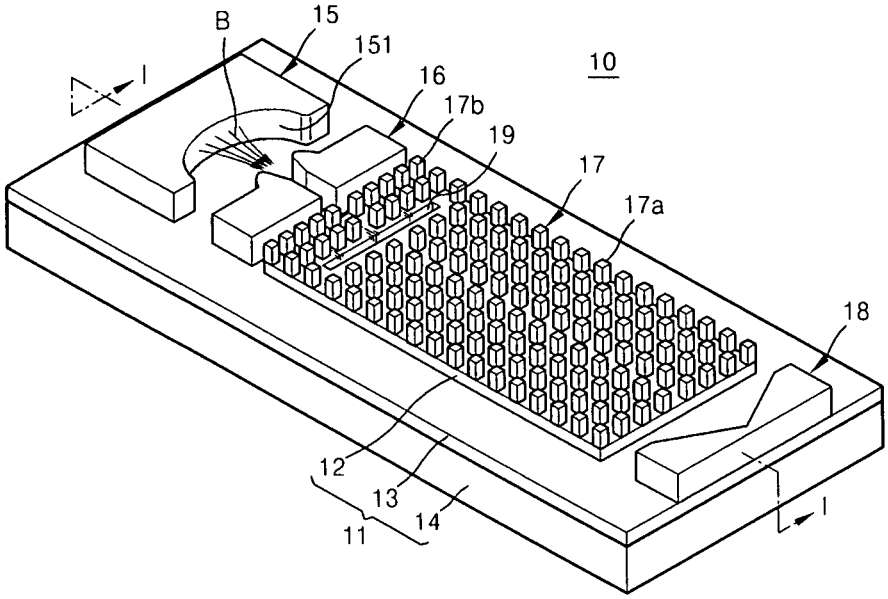
FIG. 1 is a schematic perspective view of a terahertz radiation source according to an example embodiment.

Example embodiments will now be described more fully with reference to the accompanying drawings, in which some example embodiments are shown. In the drawings, the thicknesses of layers and regions are exaggerated for clarity. Like reference numerals in the drawings denote like elements.

Detailed illustrative embodiments are disclosed herein. However, specific structural and functional details disclosed herein are merely representative for purposes of describing example embodiments. Example embodiments may, however, may be embodied in many alternate forms and should not be construed as limited to only the example embodiments set forth herein.

It should be understood, however, that there is no intent to limit the example embodiments to the particular example embodiments disclosed, but on the contrary example embodiments are to cover all modifications, equivalents, and alternatives falling within the scope.

Although the terms first, second, etc. may be used herein to describe various elements, these elements should not be limited by these terms. These terms are only used to distinguish one element from another. For example, a first element could be termed a second element, and similarly, a second element could be termed a first element, without departing from the scope of example embodiments. As used herein, the term "and/or" includes any and all combinations of one or more of the associated listed items.

When an element is referred to as being "connected," or "coupled," to another element, the element may be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular example embodiments only and is not intended to be limiting. As used herein, the singular forms "a," "an," and "the," are intended to include the plural forms as well, unless the context clearly indicates otherwise. Further, the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Figure 2:
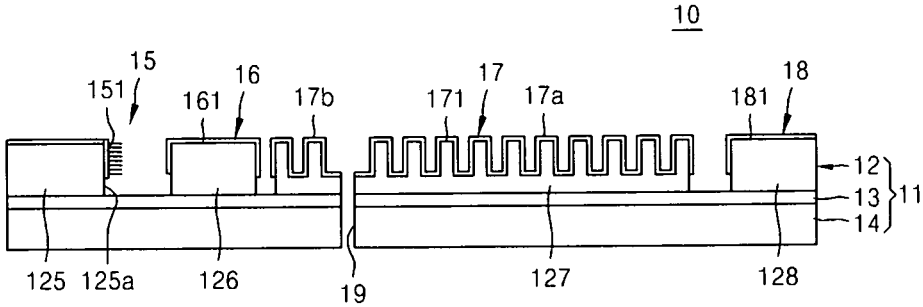
FIG. 2 is a cross-sectional side view of the terahertz radiation source in FIG. 1 taken along line I-I.

FIG. 1 is a schematic perspective view of a terahertz radiation source 10 according to an example embodiment. FIG. 2 is a cross-sectional side view of the terahertz radiation source 10 in FIG. 1 taken along line I-I.

Referring to FIGS. 1 and 2, the terahertz radiation source 10 includes an oscillating element layer having a monolithic on-chip structure. The oscillating element layer may be formed by etching a part of a substrate 11. In the example embodiment shown in FIG. 1, the oscillating element layer includes: a cathode 15, a plurality of (e.g., two) anodes 16, an oscillating circuit 17, a collector 18 and an output unit 19. As discussed herein the anodes 16 may be referred to as anode 16. Moreover, the anode 16 may include two or more anodes, or may be composed of a single anode structure.

The substrate 11 includes: an insulating layer 13 and a substrate layer 12 provided on the insulating layer 13. The insulating layer 13 is supported by a separate supporting layer 14. The substrate 11 may be a silicon-on-insulator (SOI) substrate.

The oscillating element layer including the cathode 15, the anodes 16, the oscillating circuit 17, and the collector 18 may be formed monolithically by etching the substrate layer 12. The cathode 15, the anodes 16, the oscillating circuit 17, and the collector 18 are separated from one another on the insulating layer 13, and thus, are electrically insulated from one another.

The cathode 15 is an electrode including an electron beam emitting surface 151 provided on a vertical surface 125*a* of a cathode region 125 of the substrate layer 12. The electron beam emitting surface 151 emits an electron beam B. In one example, a voltage (e.g., negative voltage) is applied to the cathode 15 by a wiring circuit (not shown) to emit the electron beam B. The cathode 15 shown in FIG. 2 may include a carbon nanotube as an electron beam emitter source. Also, the cathode 15 may include a well-known electron beam emitter source such as a thermal electron emission type emitter, a photo-excitation type emitter or the like.

The electron beam emitting surface 151, which is perpendicular or substantially perpendicular to the substrate 11, may be a concave surface with respect to an emission direction of the electron beam B.

Figure 3:
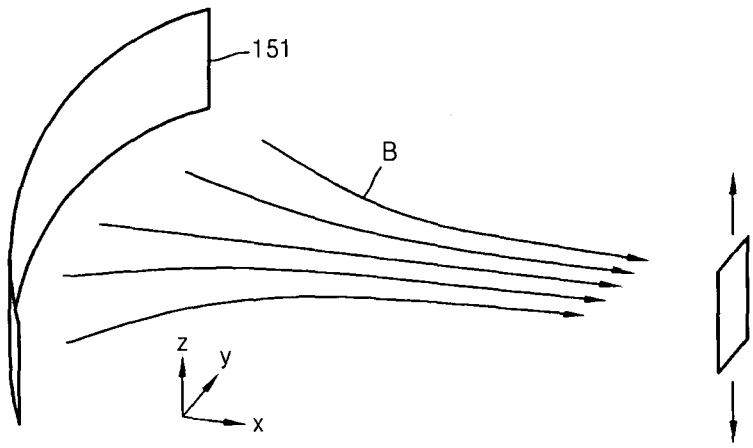
FIG. 3 is a view for describing an example operation of an electron beam emitting surface 151 of the terahertz radiation source in FIG. 1.

FIG. 3 is a view for describing an example operation of the electron beam emitting surface 151 of the terahertz radiation source 10 in FIG. 1

Referring to FIG. 3, the electron beam emitting surface 151 is perpendicular to an x-y plane and also to a surface of the substrate 11. In this example embodiment, the electron beam emitting surface 151 is a two-dimensional surface curved around a z-axis, which is perpendicular to the x-y plane. The electron beam B emitted from the electron beam emitting surface 151 moves in an x direction and is focused. The amount of focus of the electron beam B may vary according to the curvature of the electron beam emitting surface 151. As such, the electron beam B reaching the anode 16 (see, FIG. 1) may have a sheet beam shape because the electron beam emitting surface 151 is formed as a curved surface. The sheet beam shape allows the electron beam B to be more easily focused by the anode 16. Furthermore, a shape of a cross-section of the electron beam B is not limited in a vertical direction and is only limited in a horizontal direction because the terahertz radiation source 10 has a structure in which an upper portion of the substrate 11 is open. Thus, unlike a conventional terahertz radiation source having an electron beam tunnel in which the size of an electron beam B is limited vertically and generating a relatively high frequency electromagnetic wave is relatively difficult, the terahertz radiation source 10 is free or substantially free from limitation of an area condition of a minimum electron beam for generating a relatively high frequency electromagnetic wave.

The electron beam emitting surface 151 is not limited to a curved surface. For example, the electron beam emitting surface 151 may be perpendicular or substantially perpendicular to the substrate 11 and also be formed as a concave polygonal surface with respect to an emission direction of an electron beam.

Referring back to FIGS. 1 and 2, the anode 16 is adjacent to the electron beam emitting surface 151 of the cathode 15 and controls the electron beam B emitted from the cathode 15. The anode 16 may be formed by coating a metal layer 161 on an anode region 126 that is formed by etching the substrate layer 12. The anode 16 may have a shape capable of forming a distribution of an electric field so that the electron beam B emitted from the electron beam emitting surface 151 is focused by a potential difference of the electric field distribution. For example, as illustrated in FIG. 1, an anode 16 may be provided at each side of the oscillating circuit 17 with a path for the electron beam B there between. More specifically, in the example embodiment shown in FIG. 1, the path adjacent to the cathode 15 is wider than the path adjacent to the oscillating circuit 17. The structure of the anode 16 allows the electron beam B to be more easily focused. A positive voltage may be applied to the anode 16, or the anode 16 may be grounded by a wiring circuit (not shown).

Still referring to FIGS. 1 and 2, the oscillating circuit 17 is provided along the path of the electron beam B that passes through the anode 16. An electromagnetic wave oscillates in the oscillating circuit 17 due to the passing electron beam B. The oscillating circuit 17 has a photonic crystal structure including a plurality of vertically extending portions 17*a* and 17*b* arranged in a two-dimensional array. As the electron beam B passes through the vertically extending portions 17*a* and 17*b*, the electron beam B transfers the energy of the vertically extending portions 17*a* and 17*b* to the electromagnetic wave due to a periodical photonic crystal structure of the vertically extending portions 17*a* and 17*b*. Then, the electromagnetic wave exits the plurality of vertically extending portions 17*a* and 17*b*, thereby generating a terahertz electromagnetic wave. In this example, a wavelength of the oscillating electromagnetic wave may be determined according to a speed of the electron beam B and/or according to a photonic crystal structure of the oscillating circuit 17. In one example, the wavelength of the oscillating electromagnetic wave is determined according to a period, shape, and/or size of the vertically extending portions 17*a* or 17*b*. When the vertically extending portion 17*a* has a nano size (e.g., several tens of nanometers (nm)), the oscillating circuit 17 may be referred to as a nano resonance structure.

Referring back to FIG. 2, the oscillating circuit 17 may be formed by coating the metal layer 171 on a oscillating circuit region 127 of the substrate layer 12 in which the vertically extending portions 17*a* and 17*b* are patterned in a two-dimensional array. The oscillating circuit 17 may be grounded by a wiring circuit (not shown) or may be connected to the anode 16 via a common power source (not shown). Under different conditions, the vertically extending portions 17*a* and 17*b* may be formed of the substrate layer 12 itself without the metal layer 171. In this example, the vertically extending portions 17*a* and 17*b* may be formed of, for example, silicon or the like. In FIG. 1 the vertically extending portions 17*a* and 17*b* have a square column shape, but example embodiments are not limited thereto. For example, the vertically extending portions 17*a* and 17*b* may have a cylindrical shape or various other column shapes.

Still referring to FIGS. 1 and 2, the collector 18 faces the cathode 15 with the oscillating circuit 17 interposed there between. The collector 18 collects the electron beam B that has lost energy while passing through the oscillating circuit 17. The collector 18 may collect energy of the electron beam B remaining after interaction between the electron beam B and the electromagnetic wave or may suppress (e.g., prevent) the electron beam B from affecting other components. The collector 18 may be an electrode formed by coating a metal layer 181 on a collector region 128 of the substrate layer 12 etched in a given, desired or predetermined pattern. A positive voltage may be applied to the collector 18, or the collector 18 may be grounded by a wiring circuit (not shown).

The output unit 19 couples the electromagnetic waves oscillating in the oscillating circuit 17 and emits the electromagnetic wave to the outside (e.g., to an external device). The output unit 19 is formed in a slot shape penetrating the substrate 11 and to be adjacent to the anode 16. The output unit 19 may also be formed in a rectangular shape. In this example, the lengthwise direction of the rectangular shape is perpendicular or substantially perpendicular to a travelling direction of the electron beam B. Under different conditions, the output unit 19 may include a plurality of slots. The output unit 19 suppresses and/or prevents the electromagnetic wave, oscillating in the oscillating circuit 17 and moving backwards from the collector 18 to the cathode 15, from moving towards the cathode 15, and outputs the electromagnetic wave below the substrate 11. An arrangement (e.g., an arrangement period, an arrangement pattern, etc.) and a shape (e.g., an aspect ratio, a size, a shape of a cross-section, etc.) of the vertically extending portion 17*b* positioned between the output unit 19 and the anode 16 are different from those of the vertically extending portion 17*a* positioned between the output unit 19 and the collector 18, and thus backward moving of the electromagnetic wave may be effectively suppressed and/or prevented near the output unit 19. This may improve an extraction efficiency of the electromagnetic wave. A waveguide may be provided under the substrate 11 (e.g., under a portion where the output unit 19 is formed) to couple the electromagnetic waves having passed through the output unit 19 and induce the electromagnetic waves to the outside.

The terahertz radiation source 10 according to at least, this example embodiment has a structure in which an upper portion of the oscillating element layer is open, but example embodiments are not limited thereto as discussed in more detail below with regard to FIG. 4.

Figure 4:
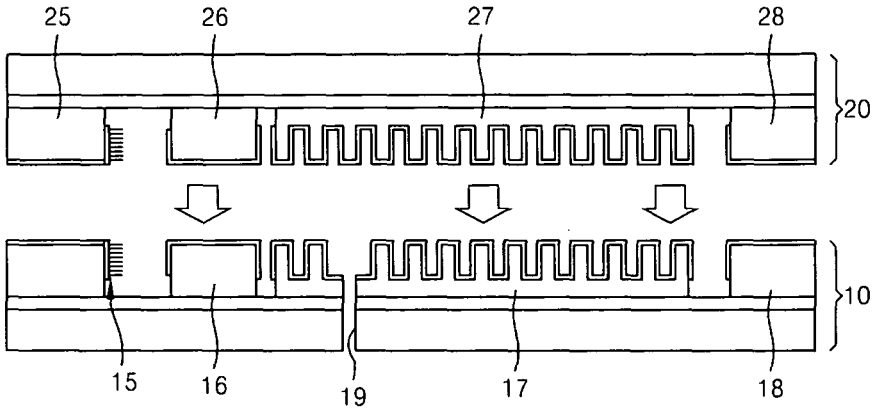
FIG. 4 is a schematic cross-sectional side view illustrating a terahertz radiation source according to another example embodiment.

FIG. 4 is a schematic cross-sectional side view illustrating a terahertz radiation source according to another example embodiment.

The terahertz radiation source 10 shown in FIG. 4 is similar to the terahertz radiation source shown in FIG. 1, except that a cover 20 is attached to an upper portion of the terahertz radiation source 10. As illustrated in FIG. 4, the cover 20 may have substantially the same structure as the terahertz radiation source 10 described with reference to FIGS. 1 through 3, except that the cover 20 does not include a slot or output unit 19.

The cover 20 includes: a second cathode 25, a second anode 26, a second oscillating circuit 27 and a second collector 28, which are the same or substantially the same as the corresponding components of the terahertz radiation source 10 described with reference to FIGS. 1 through 3.

The cover 20 is not limited to the structure illustrated in FIG. 4. For example, the cover 20 may be a flat substrate, which does not have any resonance structure and covers the overall upper portion of the terahertz radiation source. Alternatively, the cover may have a structure covering only a portion (e.g., the oscillating circuit 17) of the terahertz radiation source 10. In one example, the cover 20 may include only the second oscillating circuit 27 having a symmetrical structure with respect to the oscillating circuit 17 of the terahertz radiation source 10 or may be a flat or substantially flat substrate covering only the oscillating circuit 17.

Figure 5:
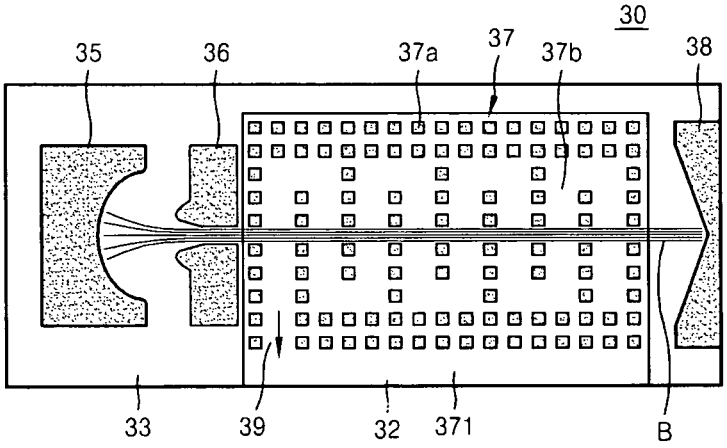
FIG. 5 is a schematic top plane view illustrating a terahertz radiation source according to yet another example embodiment.

FIG. 5 is a schematic top plane view illustrating a terahertz radiation source 30 according to another example embodiment.

Referring to FIG. 5, the terahertz radiation source 30 includes an oscillating element layer provided on an insulating layer 33. The oscillating element layer includes: a cathode 35, an anode 36, an oscillating circuit 37, a collector 38, and an output unit 39. The insulating layer 33 may be an intermediate layer of a substrate, similar or substantially similar to the example embodiments described with reference to FIGS. 1 and 2. The oscillating element layer including the cathode 35, the anode 36, the oscillating circuit 37, the collector 38, and the output unit 39 may be formed by etching the substrate layer 32 provided on the insulating layer 33.

According to at least this example embodiment, the oscillating circuit 37 has a photonic crystal structure of a folded-waveguide 37*b* formed by a plurality of vertically extending portions 37*a*. The vertically extending portions 37*a* may be formed by etching the substrate layer 37 to a given, desired or predetermined depth and then coating a metal layer 371 on the etched substrate layer 32. The folded-waveguide 37*b* may be folded at least twice when viewed from the top.

The vertically extending portions 37*a* are arranged on a region of the oscillating circuit 37, except the region where the folded-waveguide 37*b* is defined. An end of the folded-waveguide 37*b* is open to the outside to form the output unit 39. The folded-waveguide 37*b* guides the electromagnetic wave generated in the vertically extending portions 37*a* and emits the electromagnetic wave to the output unit 39. The terahertz radiation source 30 according to at least this example embodiment includes the output unit 39 formed by the folded-waveguide 37*b* of the oscillating circuit 37. Thus, components of the terahertz radiation source 30 may be substantially the same as the corresponding components of the terahertz radiation source described with reference to FIGS. 1 through 3, except for the output structure. The terahertz radiation source 30 according to at least this example embodiment does not include a slot, but rather the output unit 39 is formed by the folded-waveguide 37.

The terahertz radiation source 30 has a structure in which an upper portion of the oscillating element layer is open. However, the upper portion of the oscillating element layer may be covered by a cover similar to the example embodiment described with reference to FIG. 4. The cover may have a symmetrical structure with respect to the terahertz radiation source 30 or may be a flat substrate. Alternatively, the cover may cover only a portion of the terahertz radiation source. For example, the cover may have a second oscillating circuit that is symmetrical with respect to the oscillating circuit 37 for covering only the oscillating circuit 37, or may be a flat substrate for covering only the oscillating circuit 37.

Figure 6:
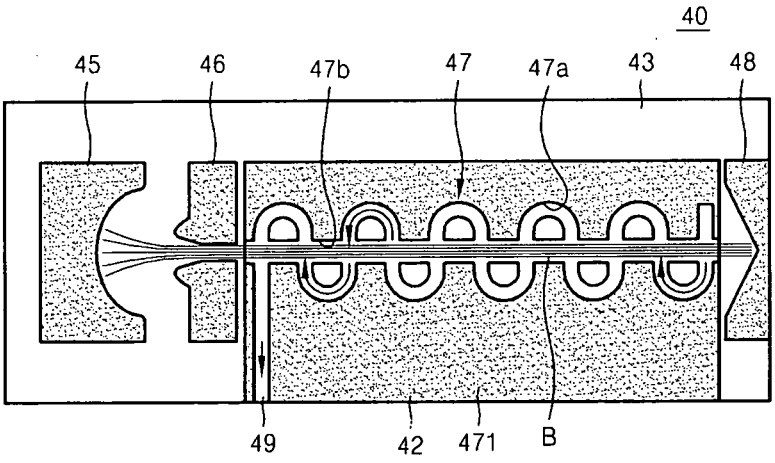
FIG. 6 is a schematic top plane view illustrating a terahertz radiation source according to still another example embodiment.

FIG. 6 is a schematic top plane view illustrating a terahertz radiation source 40 according to another example embodiment.

Referring to FIG. 6, the terahertz radiation source 40 includes an oscillating element layer provided on an insulating layer 43. The oscillating element layer includes: a cathode 45, an anode 46, an oscillating circuit 47, a collector 48, and an output unit 49. The cathode 45, the anode 46 and the collector 48 may be the same or substantially the same as the corresponding components of the example embodiment described above with reference to FIGS. 1 through 3. The insulating layer 43 may be an intermediate layer of a substrate, similar to the above-described example embodiments. The oscillating element layer including the cathode 45, the anode 46, the oscillating circuit 47, the collector 48, and the output unit 49 may be formed by etching a substrate layer 42 provided on the insulating layer 43.

According to at least this example embodiment, the oscillating circuit 47 has a folded waveguide oscillating structure including a folded waveguide 47*a* crossing the path 47*b* a plurality of times. An electron beam B passes along the path 47*b*. The folded waveguide oscillating structure may be formed by etching the substrate layer 42 to have the folded waveguide 47*a* and the path 47*b* for the electron beam B. The folded waveguide oscillating structure further includes a metal layer 471 coated on the etched substrate layer 42. An end of the oscillating circuit 47 is open to the outside to form the output unit 49. The oscillating circuit 47 having the folded waveguide resonance structure may be a traveling wave type electromagnetic wave oscillating structure. The folded waveguide resonance structure of the oscillating circuit 47 guides an electromagnetic wave generated in the oscillating circuit 47 and emits the electromagnetic wave through the output unit 49.

The terahertz radiation source 40 may have a structure in which an upper portion of the oscillating element layer is open, but example embodiments are not limited thereto. Rather, the upper portion of the terahertz radiation source 40 may be covered by a cover, similar to the example embodiments described above. In one example, the cover may have a symmetrical structure with respect to the terahertz radiation source 40. Alternatively, the cover may include only a second oscillating circuit having a symmetrical structure with respect to the oscillating circuit 47, or may be a flat substrate.

Figure 7:
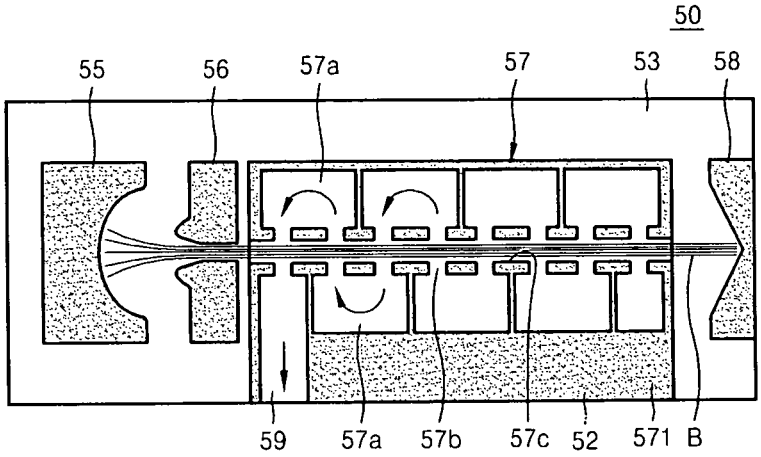
FIG. 7 is a schematic top plane view illustrating a terahertz radiation source according to another example embodiment.

FIG. 7 is a schematic top plane view illustrating a terahertz radiation source 50 according to another example embodiment.

Referring to FIG. 7, the terahertz radiation source 50 includes an oscillating element layer provided on an insulating layer 53. The oscillating element layer includes: a cathode 55, an anode 56, an oscillating circuit 57, a collector 58, and an output unit 59. The cathode 55, the anode 56 and the collector 58 may be substantially the same as the corresponding components of example embodiments described above with reference to FIGS. 1 through 3. The insulating layer 53 may be an intermediate layer of a substrate, similar to the above-described example embodiments. The oscillating element layer including the cathode 55, the anode 56, the oscillating circuit 57, the collector 58, and the output unit 59 may be formed by etching a substrate layer 52 provided on the insulating layer 53.

The oscillating circuit 57 of at least this example embodiment has a coupled-cavity resonance structure including a plurality of cavities 57*a*, which are arranged at each side of the oscillating circuit 57. A path 57*c* is formed between the cavities 57*a*, and a plurality of connecting portions 57*b* connect the cavities 57*a*. An electron beam B passes along the path 57*c*. The coupled-cavity resonance structure of the oscillating circuit 57 may be formed by etching the substrate layer 52 in a coupled-cavity pattern and then coating a metal layer 571 on the etched substrate layer 52. The cavity 57*a*, the connecting portion 57*b*, and the path 57*c* of the electron beam B may have different depths. An end of the oscillating circuit 57 is open to the outside to form the output unit 59. In example operation, an electromagnetic wave resonating in the cavity 57*a* and the connecting portion 57*b* is emitted to the output unit 59.

The terahertz radiation source 50 may have a structure in which an upper portion of the oscillating element layer is open, but example embodiments are not limited thereto. Rather, the upper portion of the oscillating element layer may be covered by a cover, similar to the example embodiment described above with reference to FIG. 4. In this example, the cover may have a symmetrical coupled-cavity resonance structure or may be a flat substrate.

Various oscillating structures, such as a nano resonance structure, a spiral oscillating structure, a surface plasmon exciting structure or a metamaterial structure, are well-known. Such oscillating structures may be used instead of the oscillating circuits of the terahertz radiation sources of the above-mentioned example embodiments.

The above-mentioned example embodiments describe only cases where a terahertz electromagnetic wave oscillates in the terahertz radiation source, but example embodiments are not limited thereto. One of ordinary skill in the art would understand that the terahertz radiation sources of the above-mentioned example embodiments may be used as a terahertz amplifier configured to input an external electromagnetic wave to an oscillating circuit and amplify the external electromagnetic wave.

FIGS. 8A through 8G are views for describing a method of manufacturing a terahertz radiation source according to an example embodiment.

Figure 8A:
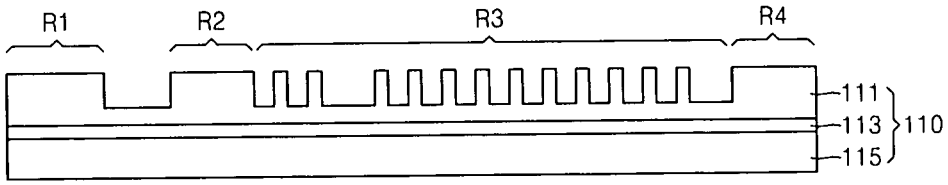
FIGS. 8A through 8G are views for describing a method of manufacturing a terahertz radiation source according to an example embodiment.

Referring to FIG. 8A, a substrate 110 is prepared. The substrate 110 may be an SOI substrate and may include a substrate layer 111, a supporting layer 115, and an insulating layer 113 interposed between the substrate layer 111 and the supporting layer 115 so as to attach the substrate layer 111 and the supporting layer 115 to each other. The substrate layer 111 may be formed using a mask patterning process on a plurality of (e.g., four) divided regions of the substrate layer 111 (e.g., a cathode region R1, an anode region R2, an oscillating circuit region R3 and a collector region R4), and then etching the regions using a deep reactive ion etching (DRIE) method. In this example, the substrate layer 111 may be etched to a depth at which electromagnetic wave oscillates (e.g., a depth less than that of the substrate layer 111).

Figure 8B:
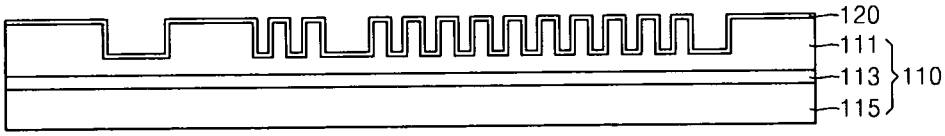

As illustrated in FIG. 8B, a metal layer 120 is formed on the etched substrate layer 111 by electron beam deposition, sputtering, plating, etc. The metal layer 120 may be formed of a metal such as Au, Cr, Cu, Ti, Mo, Al, or the like.

Figure 8C:
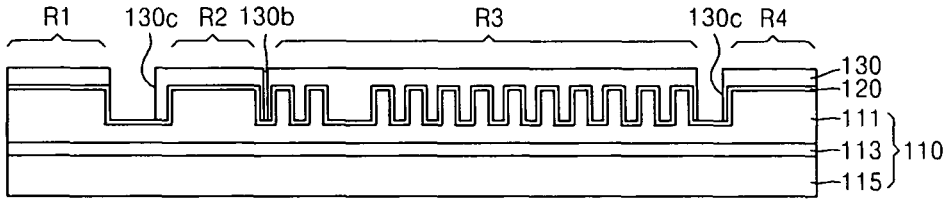

As illustrated in FIG. 8C, an upper surface of the substrate layer 111 is covered by a photo resist 130 such that the etched portion is filled and only regions formed in gaps between the cathode region R1, the anode region R2, the oscillating circuit region R3 and the collector region R4 are exposed and developed, thereby removing a part of the photo resist 130.

Figure 8D:
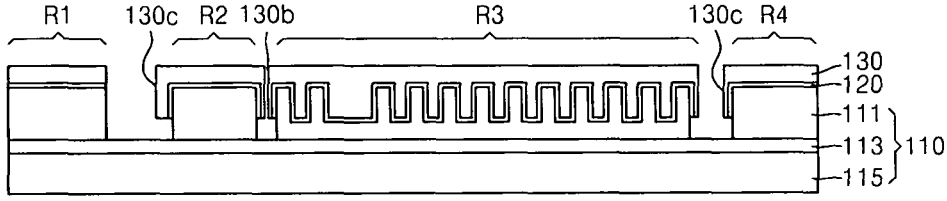

As illustrated in FIG. 8D, portions of the metal layer 120, formed on portions 130*a*, 130*b* and 130*c* where the photoresists are removed, are etched and removed. The substrate layer 111 is then etched until an insulating layer 113 is exposed, and thus the cathode region R1, the anode region R2, the oscillating circuit region R3 and the collector region R4 are insulated from one another.

Figure 8E:
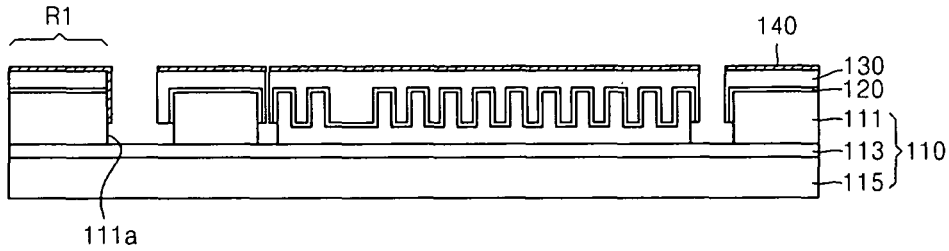

As illustrated in FIG. 8E, a catalyst layer 140 is provided on the substrate layer 111 including a vertical surface 111*a* of the cathode region R1. The catalyst layer 140 may be formed of a metal such as Co, Ni, Fe, or Invar in which a carbon nano tube may be synthesized.

Figure 8F:
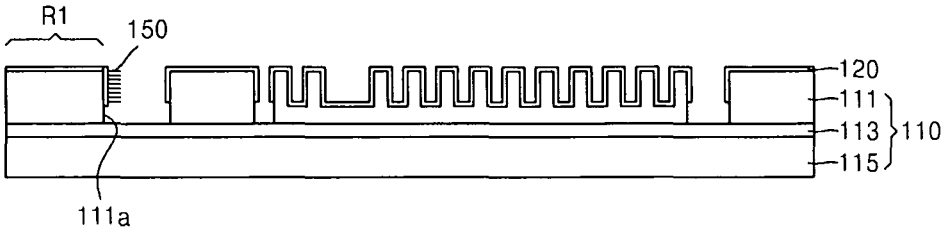

As illustrated in FIG. 8F, the catalyst layer 140 is removed, except for only the portion of the catalyst layer 140 provided on the vertical surface 111*a* of the cathode region R1, and the photo resist 130 is also removed. A carbon nano tube 150 is grown on the basis of the catalyst layer 140 provided on the vertical surface 111*a* of the cathode region R1 of the substrate layer 111 by chemical vapor deposition (CVD).

The carbon nano tube 150 is an example of an electron beam emitter source of a cathode. If the cathode is a thermal electron emission type, an electron beam emitter source formed of a material having a relatively low work function may be provided on the vertical surface 111*a* of the substrate layer 111. In alternative example embodiments, an electron beam emitter source formed of other various materials may be used.

Figure 8G:
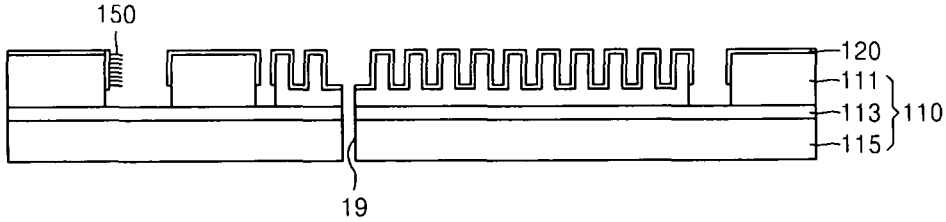

As illustrated in FIG. 8G, an output unit 190 is formed as a slot penetrating the substrate 110 in the oscillating circuit region R3. The slot may be formed by performing a backside processing on the substrate 110.

According to at least some example embodiments, a cathode, an anode, an oscillating circuit, and a collector are formed on a single substrate in a monolithic on-chip structure so that a complicated mechanical/magnetic alignment, which has been required in a conventional micro processing technology, may be simplified. Also, the terahertz radiation sources and methods of manufacturing terahertz radiation sources of the above-mentioned example embodiments facilitate a lithography process and alignment requiring intricacy as a frequency of electromagnetic wave increases. Furthermore, the terahertz radiation sources and methods of manufacturing the terahertz radiation sources of example embodiments may be realized through a relatively simple process such as a process for etching a substrate and/or a process for forming a metal layer.

It should be understood that the example embodiments described therein should be considered in a descriptive sense only and not for purposes of limitation. Descriptions of features or aspects within each example embodiments should typically be considered as available for other similar features or aspects in other example embodiments.

What is claimed is:

1. A terahertz radiation source comprising:

a cathode configured to emit an electron beam;

an anode configured to focus the electron beam emitted from the cathode;

a collector configured to collect the emitted electron beam focused by the anode;

an oscillating circuit positioned between the anode and the collector, the oscillating circuit being configured to convert energy of a passing electron beam into electromagnetic wave energy; and an output unit configured to externally emit the electromagnetic wave energy;

wherein an electron beam emitting surface of the cathode is, perpendicular to a substrate layer on which the cathode, the anode, the collector, the oscillating circuit and the output unit are formed, concave with respect to an emission direction of the electron beam, and a two-dimensional surface curved around an axis that is perpendicular to the substrate layer.

2. The terahertz radiation source of claim 1, wherein the cathode comprises:

one selected from the group including a field emission type electron beam emitter source, a thermal electron emission type electron beam emitter source, and a photo-excitation type electron beam emitter source.

3. The terahertz radiation source of claim 1, wherein the oscillating circuit has a photonic crystal structure in which a plurality of vertically extending portions are arranged in a two-dimensional array.

4. The terahertz radiation source of claim 3, wherein at least one of an arrangement and a shape of the vertically extending portions of the oscillating circuit positioned between the anode and the output unit is different from at least one of the vertically extending portions of the oscillating circuit positioned between the output unit and the collector.

5. The terahertz radiation source of claim 3, wherein the vertically extending portions of the oscillating circuit are arranged to form a waveguide that is folded at least twice, and an end of the folded-waveguide is open to the outside to form the output unit.

6. The terahertz radiation source of claim 1, wherein the substrate layer is formed on an insulating layer, the output unit comprising:

a slot formed adjacent to the anode in a region where the oscillating circuit is positioned; wherein the slot penetrates the insulating layer and the substrate layer.

7. The terahertz radiation source of claim 1, wherein the oscillating circuit has a folded waveguide resonance structure such that the oscillating circuit crosses a path of an electron beam a plurality of times, and wherein the oscillating circuit has a groove shape folded at least twice, and an end of the groove is open to the outside to form the output unit.

8. The terahertz radiation source of claim 1, wherein the oscillating circuit has a coupled-cavity resonance structure comprising:

a plurality of cavities arranged at each side of the oscillating circuit with a path between the cavities; and a plurality of connecting portions connecting the cavities; wherein an electron beam passes along the path, and an end of the cavities is open to the outside.

9. The terahertz radiation source of claim 1, wherein the oscillating circuit has at least one selected from the group including of a photonic crystal structure, a nano resonance structure, a coupled-cavity resonance structure, a folded-waveguide resonance structure, a spiral oscillating structure, a groove structure, a forward wave structure, a surface plasmon exciting structure and a meta-material structure for oscillating a terahertz electromagnetic wave.

10. The terahertz radiation source of claim 1, further comprising:

a cover covering the oscillating circuit.

11. The terahertz radiation source of claim 10, wherein the cover comprises:

a second oscillating circuit having a symmetrical structure with respect to at least the oscillating circuit.

12. The terahertz radiation source of claim 1, further comprising:

a cover covering at least the cathode, the anode, the collector, and the oscillating circuit.

13. The terahertz radiation source of claim 1, further comprising:

a cover having a symmetrical structure with respect to the terahertz radiation source.

14. The terahertz radiation source of claim 1, wherein at least one of the cathode, the anode, the collector, and the oscillating circuit includes a metal layer coated on an etched substrate layer.

15. The terahertz radiation source of claim 1, wherein the cathode, anode, collector, oscillation circuit and output unit compose an oscillating element layer, the radiation source further comprising:

an insulating layer on which the oscillating element layer is formed.

16. The terahertz radiation source of claim 15, wherein the insulating layer and a the substrate layer are layers of a silicon on insulator (SOI) substrate.

17. The terahertz radiation source of claim 1, wherein the oscillating circuit has at least one of a photonic crystal structure and a folded-waveguide resonance structure for oscillating a terahertz electromagnetic wave.

18. A method of manufacturing a terahertz radiation source, the method comprising:

etching a substrate layer formed on an insulating layer to form an oscillating element layer including a cathode region, an anode region, an oscillating circuit region, and a collector region; and forming an electron beam emitter source in the cathode region of the substrate layer;

wherein the electron beam emitting surface of the cathode region is, perpendicular to the insulating layer, concave with respect to an emission direction of an electron beam, and a two-dimensional surface curved around an axis that is perpendicular to the substrate layer.

19. The method of claim 18, wherein the forming of the oscillating element layer comprises:

dividing and etching the substrate layer into the cathode region, the anode region, the oscillating circuit region, and the collector region;

coating a metal layer on the cathode region and the anode region; and etching a portion of the substrate layer, except for the cathode region, the anode region, the oscillating circuit region, and the collector region, until a portion of the insulating layer is exposed.

20. The method of claim 18, wherein the oscillating circuit region is patterned to have at least one selected from the group including a photonic crystal structure, a nano resonance structure, a coupled-cavity resonance structure, a folded-waveguide resonance structure, a spiral oscillating structure, a groove structure, a forward wave structure, a surface plasmon exciting structure and a meta-material structure for oscillating a terahertz electromagnetic wave.

21. The method of claim 18, wherein the substrate is a silicon on insulator (SOI) substrate.

* * * * *